US005850668A

United States Patent [19]

Berfield et al.

[11] Patent Number: 5,850,668

[45] Date of Patent: Dec. 22, 1998

[54] SELF-EVACUATING VACUUM CLEANER

[75] Inventors: Robert C. Berfield, Jersey Shore; Randy L. Buss, Hughesville; Craig A. Seasholtz, Avis, all of Pa.

[73] Assignee: Shop Vac Corporation, Williamsport, Pa.

[21] Appl. No.: 678,997

[22] Filed: Jul. 12, 1996

[51] Int. Cl.[6] ..... A47L 7/00

[52] U.S. Cl. ..... 15/353; 15/321

[58] Field of Search ..... 15/352, 353, 321; 96/406

[56] References Cited

U.S. PATENT DOCUMENTS

| | | | |
|---|---|---|---|
| D. 344,822 | 3/1994 | Miller et al. . | |
| D. 354,380 | 1/1995 | Stephens . | |
| D. 355,109 | 2/1995 | Moine et al. . | |
| D. 357,336 | 4/1995 | Moine et al. . | |
| D. 357,773 | 4/1995 | Wareham et al. . | |
| D. 361,179 | 8/1995 | Moine et al. . | |
| D. 372,567 | 8/1996 | Moine et al. . | |
| D. 373,862 | 9/1996 | Stephens et al. . | |
| 961,816 | 6/1910 | Squier . | |
| 1,661,480 | 3/1928 | Keefer . | |
| 1,691,164 | 11/1928 | Monk | 15/321 |
| 1,840,257 | 1/1932 | Saxe et al. . | |
| 1,849,093 | 3/1932 | Janette . | |
| 1,982,345 | 11/1934 | Kirby . | |
| 1,993,267 | 3/1935 | Ferguson . | |
| 2,034,623 | 4/1936 | Christensen . | |
| 2,049,603 | 8/1936 | Dietenberger . | |
| 2,292,435 | 8/1942 | Crites | 15/321 |
| 2,424,657 | 7/1947 | Goodman . | |
| 2,470,066 | 5/1949 | Calabrese . | |
| 2,499,876 | 3/1950 | Platek . | |
| 2,643,732 | 6/1953 | Keen . | |
| 2,657,416 | 11/1953 | Smith . | |
| 2,718,656 | 9/1955 | Kirk . | |
| 2,757,406 | 8/1956 | Decker . | |
| 2,791,964 | 5/1957 | Reeve . | |
| 2,909,800 | 10/1959 | Grindle et al. . | |
| 2,932,844 | 4/1960 | O'Connor | 15/321 |
| 2,972,769 | 2/1961 | Keating et al. . | |
| 3,029,461 | 4/1962 | Osborn . | |
| 3,048,875 | 8/1962 | Bottinelli et al. . | |
| 3,303,785 | 2/1967 | Pearce . | |
| 3,327,144 | 6/1967 | Double . | |
| 3,345,488 | 10/1967 | Siegal . | |
| 3,355,762 | 12/1967 | Cavell et al. . | |
| 3,398,250 | 8/1968 | Bowers . | |
| 3,471,663 | 10/1969 | Farrell et al. . | |
| 3,496,592 | 2/1970 | Jones . | |
| 3,502,825 | 3/1970 | Bailey et al. . | |
| 3,552,100 | 1/1971 | Ekenberg . | |
| 3,605,786 | 9/1971 | Machin, Jr. . | |
| 3,614,797 | 10/1971 | Jones . | |

(List continued on next page.)

FOREIGN PATENT DOCUMENTS

| | | |
|---|---|---|
| 0 012 337 A | 6/1980 | European Pat. Off. . |
| 0 017 519 A | 10/1980 | European Pat. Off. . |
| 2 484 558 | 12/1981 | France . |
| 40 17 366 A | 12/1991 | Germany . |

*Primary Examiner*—Chris K. Moore

*Attorney, Agent, or Firm*—Marshall, O'Toole, Gerstein, Murray & Borun

[57] ABSTRACT

A vacuum cleaner has an electric motor driving an air impeller that creates low pressure inside the tank of the vacuum cleaner. The motor also drives a pump impeller which is located in the tank and draws liquid material from the bottom of the tank and expels it from the tank. Near an inlet to the pump is a priming mechanism having bellows which are compressed to force liquid material up into the pump. Portions of the pump, including the inlet and the outlet as well as the priming mechanism, are attached to a tank extension which fits over the top of the tank. The lid of the vacuum cleaner, which carries the motor and air impeller, fits over the tank extension when the vacuum cleaner is used for liquid material. The tank extension and its associated pump components are removable from the tank to facilitate use of the vacuum cleaner on dry material.

16 Claims, 7 Drawing Sheets

U.S. PATENT DOCUMENTS 3,616,482 11/1971 Brycki .
3,720,977 3/1973 Brycki .
3,774,260 11/1973 Emus, Jr. .
3,818,537 6/1974 Evans .
3,828,390 8/1974 Cater .
3,909,197 9/1975 Cremers .
3,914,592 10/1975 Maxey .
3,939,527 2/1976 Jones .
3,942,217 3/1976 Bates .
3,977,797 8/1976 Paterson .
4,021,144 5/1977 Matsusaka .
4,080,104 3/1978 Brown, Jr. .
4,087,706 5/1978 Koester, Jr. .
4,087,881 5/1978 Bates .
4,114,229 9/1978 Jones et al. .
4,123,818 11/1978 Hurwitz .
4,138,761 2/1979 Nauta .
4,153,968 5/1979 Perkins ..... 15/321
4,171,208 10/1979 Lowder .
4,179,768 12/1979 Sawyer .
4,185,354 1/1980 Brazier .
4,194,262 3/1980 Finley .
4,207,649 6/1980 Bates .
4,216,563 8/1980 Cyphert .
4,218,805 8/1980 Brazier .
4,226,000 10/1980 Tribolet .
4,244,079 1/1981 Bane .
4,267,617 5/1981 Brown et al. .
4,287,636 9/1981 Brazier .
4,314,385 2/1982 Wimsatt et al. .
4,318,202 3/1982 Holman .
4,321,219 3/1982 Barker .
4,329,756 5/1982 Chicoine et al. .
4,348,783 9/1982 Swanson et al. .
4,353,145 10/1982 Woodford .
4,397,057 8/1983 Harbeck .
4,458,377 7/1984 Frohbieter .
4,654,926 4/1987 McCambridge .
4,667,364 5/1987 Meili .
4,675,935 6/1987 Kasper et al. .
4,741,069 5/1988 Helm et al. .
4,776,058 10/1988 Garner et al. .
4,788,738 12/1988 Monson et al. .
4,800,612 1/1989 Valentine .
4,800,613 1/1989 Blase et al. .
4,801,376 1/1989 Kulitz .
4,809,396 3/1989 Houser .
4,827,562 5/1989 Blase et al. .
4,841,595 6/1989 Wiese .
4,845,793 7/1989 Meyer .
4,847,943 7/1989 Blase et al. .
4,864,680 9/1989 Blase et al. .
4,934,017 6/1990 Kent .
4,949,424 8/1990 Shero .
4,956,891 9/1990 Wulff .
4,974,282 12/1990 Stoltz et al. .
4,976,850 12/1990 Kulitz .
4,977,638 12/1990 Best .
5,012,549 5/1991 Williams et al. .
5,048,148 9/1991 Gleadall .
5,086,537 2/1992 McDowell et al. .
5,099,543 3/1992 Wade .
5,120,922 6/1992 Brouilette .
5,125,126 6/1992 Bonnant .
5,134,748 8/1992 Lynn .
5,174,730 12/1992 Nieuwkamp et al. .
5,182,834 2/1993 Wright et al. .
5,184,370 2/1993 Jung ..... 15/321
5,189,755 3/1993 Yonkers et al. .
5,210,902 5/1993 Lee et al. .
5,244,003 9/1993 Boomgaarden .
5,263,225 11/1993 Winters .
5,267,370 12/1993 Worwag .
5,287,587 2/1994 Yonkers et al. .
5,287,590 2/1994 Yonkers et al. .
5,289,611 3/1994 Yonkers et al. .
5,330,699 7/1994 Shetler et al. .
5,373,606 12/1994 Bosyj et al. .
5,388,301 2/1995 Bosyj et al. .
5,404,614 4/1995 Stephens .
5,406,673 4/1995 Bradd et al. .
5,430,910 7/1995 Wiley .
5,443,362 8/1995 Crites et al. .
5,455,983 10/1995 Crouser et al. .
5,455,984 10/1995 Blase .
5,465,455 11/1995 Allen .
5,469,598 11/1995 Sales .
5,526,547 6/1996 Williams et al. .
5,535,500 7/1996 Stephens et al. .

SELF-EVACUATING VACUUM CLEANER

FIELD OF THE INVENTION

The present invention relates to vacuum cleaners and more particularly to wet/dry vacuum cleaners where liquid material in the tank of the vacuum cleaner is pumped out to waste.

BACKGROUND ART

Tank-type vacuum cleaners are capable of receiving dry materials such as debris or dirt and may also be used for suctioning liquids. When the tank is full, a tank lid (which often includes a motor and an air impeller) is removed and the contents are dumped out. If the vacuum cleaner is used on liquid material, the tank, when at or near capacity, may be very heavy so that lifting the tank, to pour the contents into a sink or the like, is difficult. Even tilting the tank to pour the contents into a floor drain may be unwieldy when the liquid level in the tank is high.

One solution to the difficulties encountered in emptying liquid from vacuum tanks has been to provide an outlet at the bottom of the tank. Such a solution is satisfactory when the contents of the tank are emptied into a floor drain; however, if no floor or other low-placed drain is available the tank must be lifted to a sink or similar disposal site. In such cases the outlet at the bottom of the tank is of little value.

A second solution to emptying a vacuum tank of liquid is to provide a pump, usually with a motor located outside of or in the bottom of the tank. The pump removes liquid through a lower portion of the tank and expels it through a hose to waste. While such pumps are generally effective, they may be very costly. The pump requires not only a pump impeller and hoses but also its own electric motor, power cords, and switches. The expense of such items may be significant in the context of the overall cost of a vacuum cleaner, particularly those designed for residential use. Such pumps may also reduce the size of the vacuum tank or interfere with operation when the vacuum cleaner is used on dry materials.

SUMMARY OF THE INVENTION

In accordance with one aspect of the present invention, a vacuum cleaner has a tank for collecting vacuumed materials and an air impeller for creating low pressure in the tank to draw material into the tank. A shaft extends from the air impeller and rotates with the air impeller. A pump impeller is mechanically connected to the air impeller by the shaft so that the pump impeller draws the vacuumed material out of the tank.

The vacuum cleaner may have a motor driving the air impeller and the pump impeller. A tank lid may carry the motor and the air impeller, and may also carry an upper pump assembly which includes the pump impeller. A lower pump assembly is removably attached to the upper pump assembly, and the lower pump assembly includes a pump inlet tube communicating with a lower portion of the tank. The vacuum cleaner may have a tank extension which is supported by the tank between the tank and the tank lid. The tank extension is removable from the tank and the tank lid, and carries the lower pump assembly. The lower pump assembly may have a fluid filter and means for sending a priming fluid toward the pump impeller.

A pump for the vacuum cleaner including the pump impeller may have an inlet near a lower portion of the tank. An outlet is provided exterior to the tank so that material in the tank is drawn into the pump inlet by the pump impeller and expelled from the pump outlet. A bellows is connected to the pump inlet and has an opening to permit liquid in the tank to enter into the bellows. When the bellows are compressed, liquid is forced from the bellows toward the pump impeller. The bellows may be compressed by a handle connected to the bellows and located outside the tank.

The vacuum cleaner may have a level sensor for detecting material in the tank at or above a specified level, which may then interrupt power to the air impeller. An override switch may provide power to the air impeller when the power has been interrupted because the level sensor detected material in the tank at or above the specified level.

In accordance with another aspect of the present invention, a wet/dry vacuum cleaner may have a tank for receiving vacuumed material and a tank lid carrying a motor and an air impeller. A pump removes liquid material from the tank and includes an upper pump assembly having a pump impeller where the upper pump assembly is attached to the lid. The pump also includes a lower pump assembly which is removably attached to the upper pump assembly. The lower pump assembly includes a pump inlet tube communicating with a lower portion of the tank.

The vacuum cleaner may have a lid extension where an outlet for the pump passes through the lid extension. A priming handle may also pass through the lid extension.

The upper pump assembly may include an impeller housing, and the lower pump assembly may include a pump outlet fitting. The pump outlet fitting contains an inlet tube having a seal, and the pump outlet fitting contains an inlet tube having a seal communicating with an outlet to the tank, and includes a fitting having a seal. The seal on the inlet tube and the seal on the outlet fitting, each separate to separate the upper pump assembly to the lower pump assembly.

In accordance with another aspect of the present invention, a vacuum cleaner has a tank for collecting vacuumed material. An air impeller is driven by a source of mechanical force to create a low-pressure area in the tank to draw material into the tank. A pump is located in the tank and driven by the source of mechanical force. An inlet to the pump is near a lower portion of the tank and an outlet to the pump is exterior to the tank. Liquid material in the tank is drawn into the pump inlet by the pump impeller and expelled through the pump outlet.

The air impeller may rotate about a first shaft, and the pump impeller may rotate about a second shaft. The first shaft may be essentially collinear with the second shaft. The second shaft may connect the air impeller to the pump impeller.

Other features and advantages are inherent in the vacuum cleaner claimed and disclosed or will become apparent to those skilled in the art from the following detailed description in conjunction with the accompanying drawings.

DETAILED DESCRIPTION OF THE PREFERRED EMBODIMENT

Figure 1:
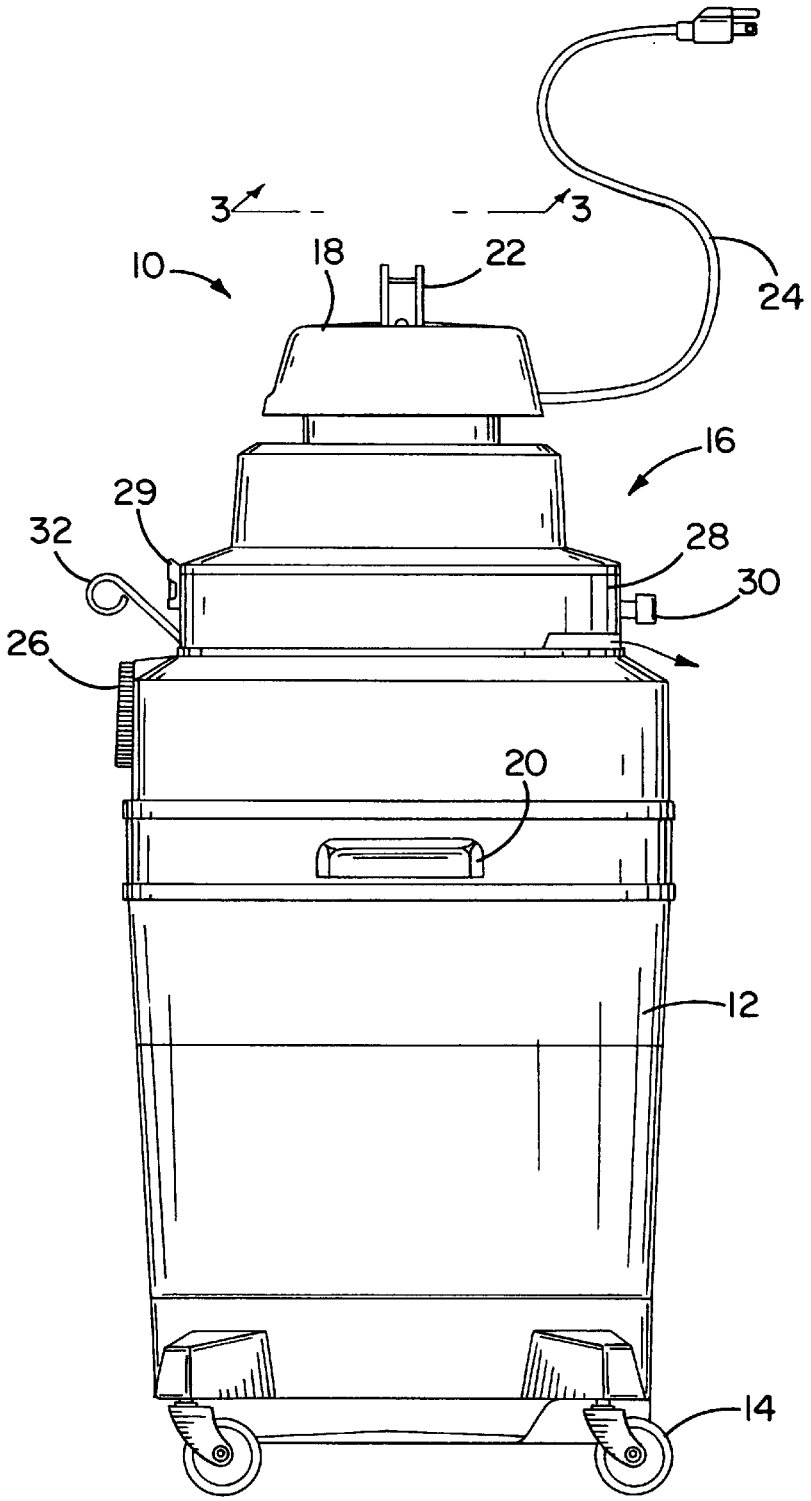
FIG. 1 is a side-elevational view of a vacuum cleaner of the present invention.

Referring initially to FIG. 1, a vacuum cleaner of the present invention, indicated generally at 10, has a tank 12 supported by casters 14. The tank 12 is covered by a lid, indicated generally at 16, which includes a motor housing 18. The vacuum cleaner 10 can be moved using handles 20 and 22 attached, respectively, to the tank 12 and the motor housing 18. An electric cord 24 passes through the motor housing 18 to provide electric power to the vacuum cleaner 10.

The tank 12 has an inlet 26 which may be fitted with a vacuum hose (not depicted) for directing suction at desired locations. Air drawn into the inlet 26 by the vacuum cleaner 10 is expelled under the motor housing 18 as shown by the arrows. In FIG. 1, the tank 12 is fitted with a removable tank extension 28. The tank extension 28 may be held to the lid 16 by one or more latches 29 carried by the lid 16. The tank extension 28 has a pump outlet 30 which, as described more fully below, discharges liquid material which has been collected in the tank 12 by the vacuum cleaner 10. A priming handle 32 extends from the tank extension 28 and is also described more fully below.

Figure 2:
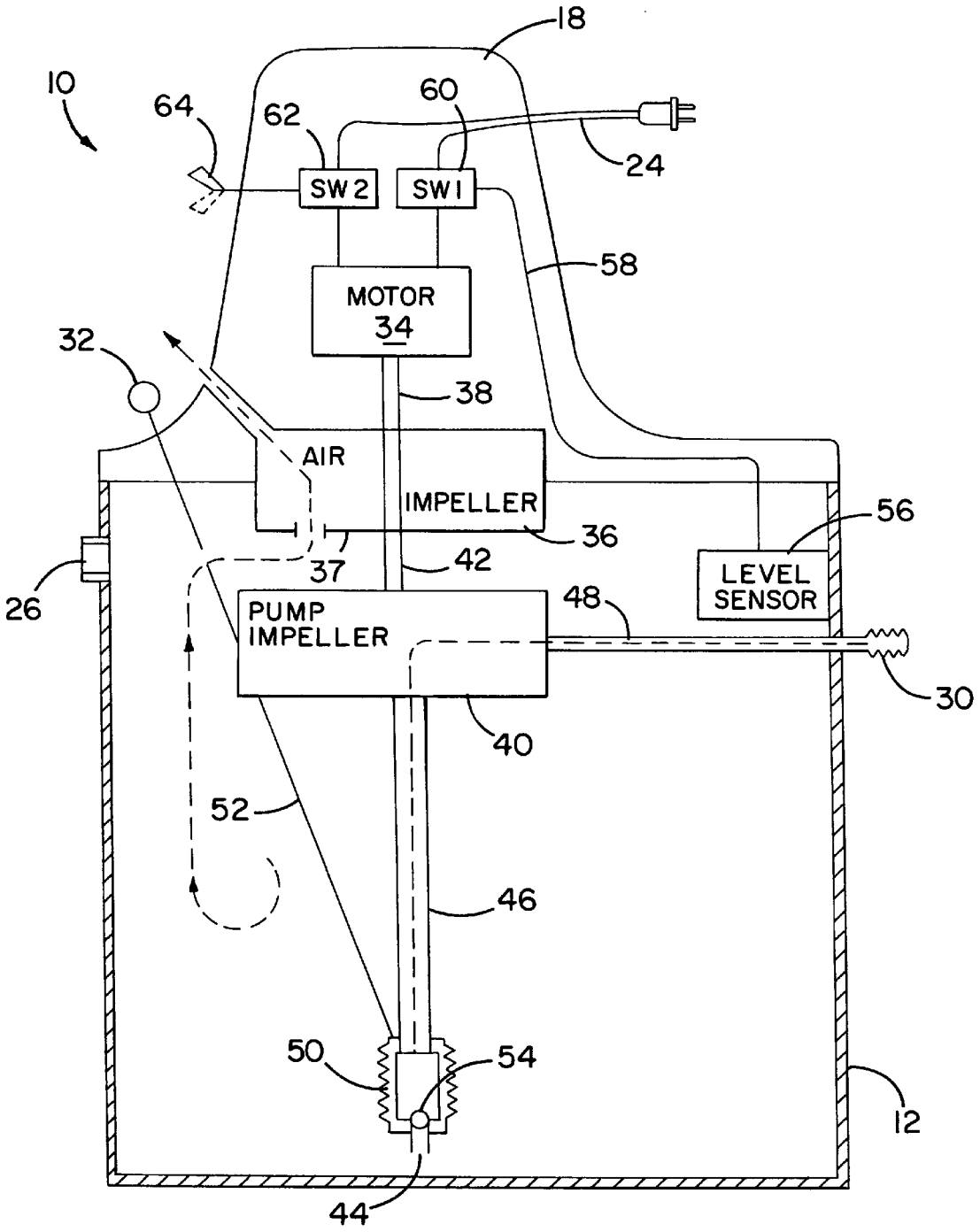
FIG. 2 is a diagrammatic view of a vacuum cleaner of the present invention.

FIG. 2 is a diagram showing the overall electrical and mechanical operation of the vacuum cleaner 10. A motor 34 drives an air impeller 36 via a shaft 38. The air impeller 36 draws air through an opening in an air impeller housing 37 from the tank 12, which in turn draws air and other material through the inlet 26. Air may be expelled directly from the air impeller 36 through the motor housing 18, or may pass through or over the motor 34 to provide cooling.

A pump impeller 40 is driven by a shaft 42 which passes through the opening in the air impeller housing 37. The shaft 38 may be integral with the shaft 42 so that a unitary structure drives both the air impeller 36 and the pump impeller 40. Alternatively the shaft 42 may be separate from the shaft 38, in which case the shafts are preferably essentially collinear. As yet another alternative, the shaft 38 and the shaft 42 may not be collinear but may instead transfer torque from the motor 34 through the shaft 38 to the shaft 42 and pump impeller 40 via a transmission or gears.

Rotation of the pump impeller 40 draws liquid into a pump inlet 44 and through an inlet tube 46. Liquid material reaching the pump impeller 40 is discharged through an outlet tube 48 to the pump outlet 30. A hose (not depicted) may be attached to the pump outlet 30 so that liquid material removed from the tank 12 can be directed to a drain or a sink.

In order to provide priming fluid to the pump impeller 40, a bellows 50 may be compressed by use of the priming handle 32 and a priming rod 52. When liquid material enters the tank 12 it collects in the bottom of the tank 12 and enters the bellows 50 through the pump inlet 44. When there is a sufficient level of liquid material in the bellows 50 a user pulls on the priming handle 32 to compress the bellows 50. A check valve 54 adjacent the pump inlet 44 permits liquid to enter the bellows 50 through the pump inlet 44 but resists flow of material from the bellows 50 out through the pump inlet 44. Therefore, compression of the bellows 50 forces liquid material up through the inlet tube 46 to the pump impeller 40. When the liquid material reaches the pump impeller 40 the pump is primed and draws the liquid material up through the inlet tube 46 and expels the liquid out the outlet tube 48.

Because of the necessity of priming the pump impeller 40 and the fact that the air impeller 36 may draw material into the tank 12 faster than the pump impeller 40 can remove it, there exists the possibility that the tank 12 will become overfilled with liquid material. A level sensor 56 may therefore be provided to detect when the level of liquid in the tank 12 is at or above a specified level. When the level sensor 56 detects liquid at or above the specified level it sends a signal through a wire 58 to a switch 60. The switch 60, upon receiving a signal through the wire 58, interrupts current flowing through the electric cord 24 to the motor 34. The motor 34 and air impeller 36 thereby cease operating so that no additional liquid material enters the tank 12.

Interruption of power to the motor 34 and the air impeller 36 also prevents the pump impeller 40 from operating. Under such a condition, liquid material previously collected in the tank 12 is not being removed. A switch 62 with a toggle actuator 64 is therefore provided to allow a user to override the interruption in power caused by activation of the level sensor 56. The toggle actuator 64 is spring-biased in its off position and must be held down in order for the switch 62 to provide electric power to the motor 34. While the user holds down the toggle actuator 64, the user is aware that the tank 12 is full and that the user should avoid further suctioning of additional liquid material into the tank 12 through the tank inlet 26. As the motor 34 continues to operate, the pump impeller 36 empties the tank to a level below the specified level for the level sensor 56 so that switch 60 thereafter permits flow of electric power to the motor 34 without the need to hold down the toggle 64. A second level sensor (not depicted) may be placed at a higher level which prevents the interruption in power from being overridden. Thus, if the user holds down the toggle while allowing the additional liquid material to enter the tank 12, the second sensor will prevent the tank 12 from overfilling. Numerous types of level sensors 56 may be used, including float sensors, proximity sensors, pairs of electrodes which pass current to each other through liquid in the tank when the liquid is at a sufficient height, etc. . .

Instead of the level sensor 56 and toggle 64 shown in FIG. 2, two level sensors could be provided (not depicted). In such a system the first, lower sensor activates a light or alarm to warn the user that the tank 12 is almost full. The second sensor is at a higher level in the tank and interrupts power to the motor 34 if the level in the tank is allowed to continue to rise. When notified by the light or alarm that the tank is nearly full, the user ceases suctioning additional material into the tank until the level of liquid material in the tank is lowered. If the user fails to heed the warning and the liquid level in the tank continues to rise, the second level sensor interrupts power to the motor.

Figure 3:
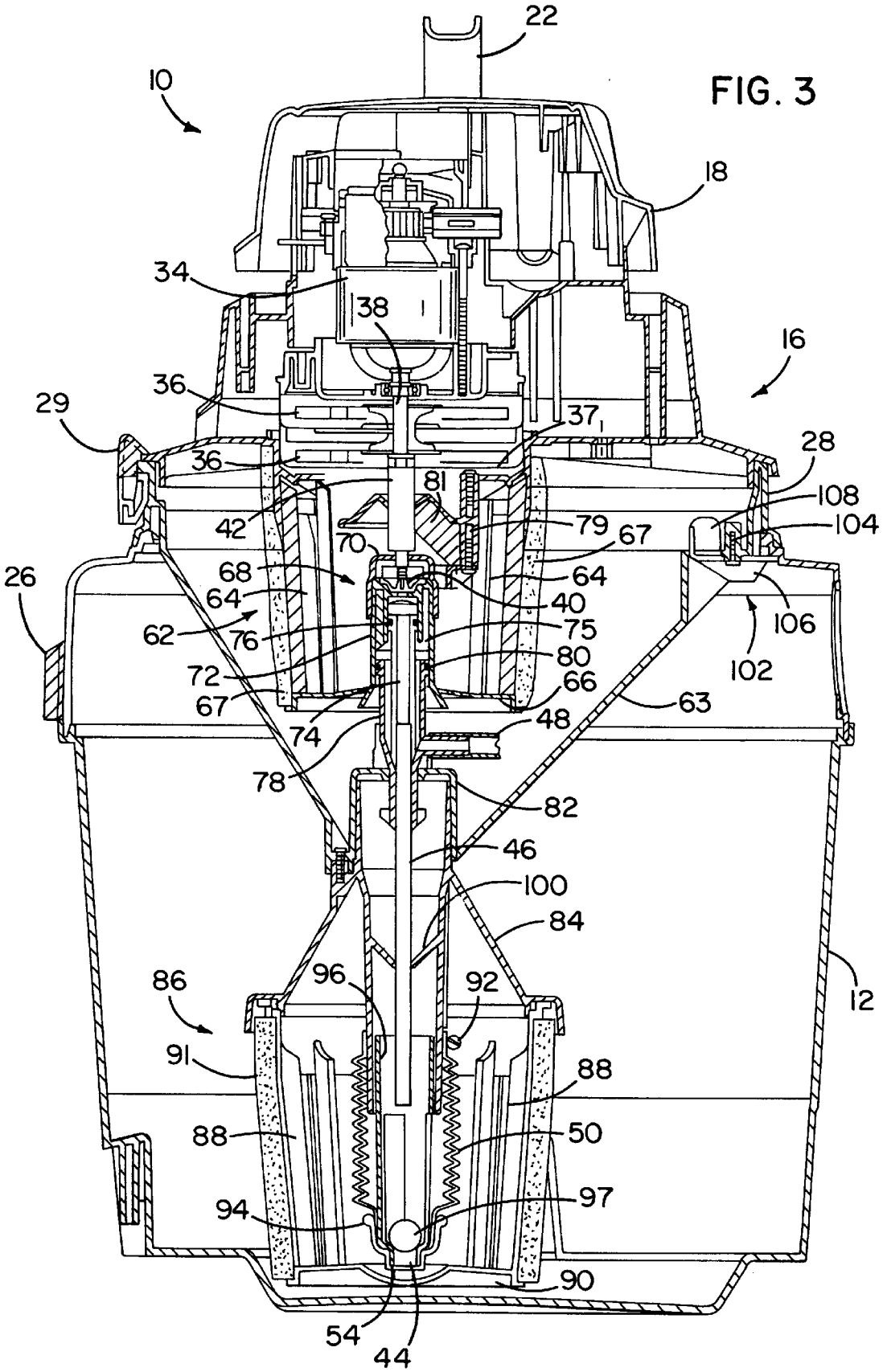
FIG. 3 is a sectional view taken along the line 3—3 in FIG. 1.
Figure 4:
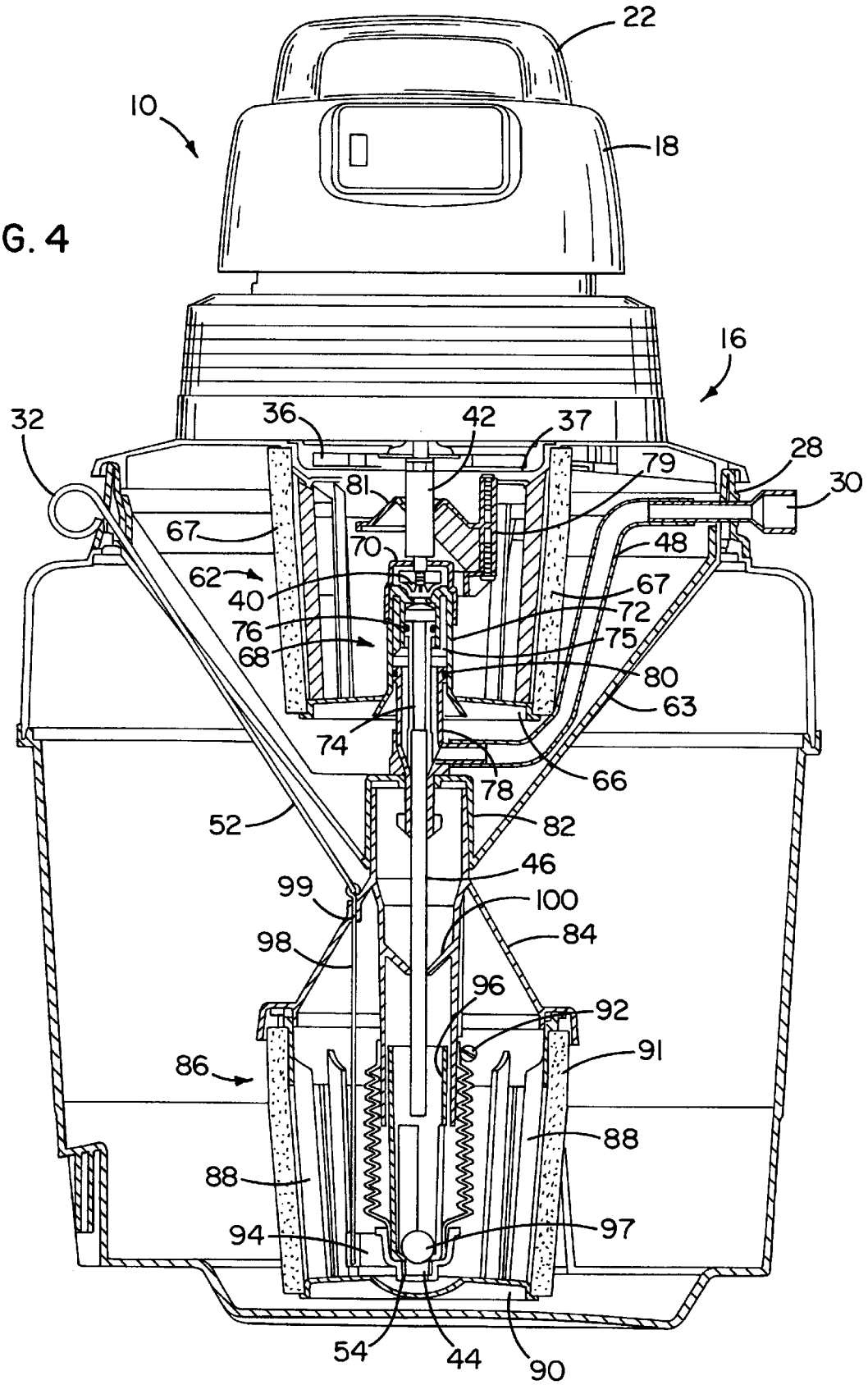
FIG. 4 is a side-elevational view, partially in section, showing the vacuum cleaner of FIG. 1.

FIGS. 3 and 4 depict the internal structure of the vacuum cleaner 10. The mechanical power for the vacuum cleaner is provided by the electric motor 34, which may be of any type used for vacuum cleaners. FIG. 3 depicts the motor 34 driving two air impellers 36 mounted in an air impeller housing 37 via the first axle 38. Two air impellers may provide more desirable air flow characteristics than a single impeller; however, the vacuum cleaner 10 may have only a single air impeller. The air impellers 36 draw air through a lid cage indicated generally at 62, which in turn draws air through a depending portion 63 of the tank extension 28. The tank extension 28 has several holes or slots (not depicted) to permit air flow to the air impeller 36. The lid cage 62 has several braces 64 supporting a plate 66 and surrounded by a foam filter 67. The lid 16, which carries the cage 62, impellers 36, motor 34, and motor housing 18, may be of conventional construction. Except for the pump discussed below, the lid 16 and its associated components may be identical to a Shop Vac Model QL20TS vacuum cleaner as manufactured by Shop Vac Corporation of Williamsport, Pa.

A pump indicated generally at 68 includes the pump impeller 40, which is mounted between an upper impeller housing 70 and a lower impeller housing 72. An inlet tube 74 is telescoped within the lower impeller housing 72, and a seal 76 prevents escape of fluid from the tube 74 and the housing 72. The inlet tube 74 is secured by any suitable means to the inlet tube 46. The impeller 40 draws liquid through the inlet tubes 46 and 74 and discharges same into a discharge recess 75 surrounding the tubes 46 and 74. The discharge recess 75 is enclosed by the lower impeller housing 72 and a pump outlet fitting 78. The pump outlet fitting 78 is telescoped within the housing 72, and a seal 80 prevents escape of liquid past the interface between the housing 72 and the pump outlet fitting 78. Liquid from the pump 68 passes out of the pump fitting 78, into the outlet tube 48, and out of the tank 12 through the pump outlet 30 (FIG. 4).

The lower pump housing 72 is attached to the upper pump housing 68, which is in turn attached to a pump mount 79. The pump mount 79 is attached to the air impeller housing 37 on the lid 16. The pump mount 79 also carries a water deflector 81, which inhibits water from passing into the air impellers 36. Ordinary pumps have a seal where the shaft 42 passes through the upper impeller housing 70. The pump 68 has no such seal because seals often require cooling fluid and the pump impeller 40 may rotate without any fluid in the upper impeller housing 70. A small amount of liquid will therefore pass out of the upper impeller housing 70 around the shaft 42. The water deflector 81 will direct the liquid back into the tank 12.

The pump outlet fitting 78 is mounted to an inverted cup 82 on the tank extension 28. The tank extension 28 carries an intake support 84 and a lower cage indicated generally at 86 having brackets 88 and a plate 90. The lower cage 86 may be surrounded by a foam filter 91 to prevent large particles suspended in liquid in the tank 12 from entering the pump inlet 44. The lower cage 86 also houses the priming mechanism for the pump 68, including the bellows 50, which is secured to the intake support 84 by a hose clamp 92. The lower end of the bellows 50 is captured between a bracket 94 and a cup 96. The bellows 50, bracket 94, and the cup 96 each have an opening to allow liquid material in the tank 12 to enter into the cup 96. A ball 97 seats in the cup 96 to form the check valve 54 which prevents liquid material in the cup 96 from flowing out of the cup 96 through outlet 44. A priming rod 98 (FIGS. 4 and 5) extends through a hole 99 in the intake support 84 and is attached to the priming rod 52 to a bracket extension 94 so that upward movement of handle 32 from tank extension 28 lifts the bracket 94 and the cup 96 to compress the bellows 50.

Figure 5:
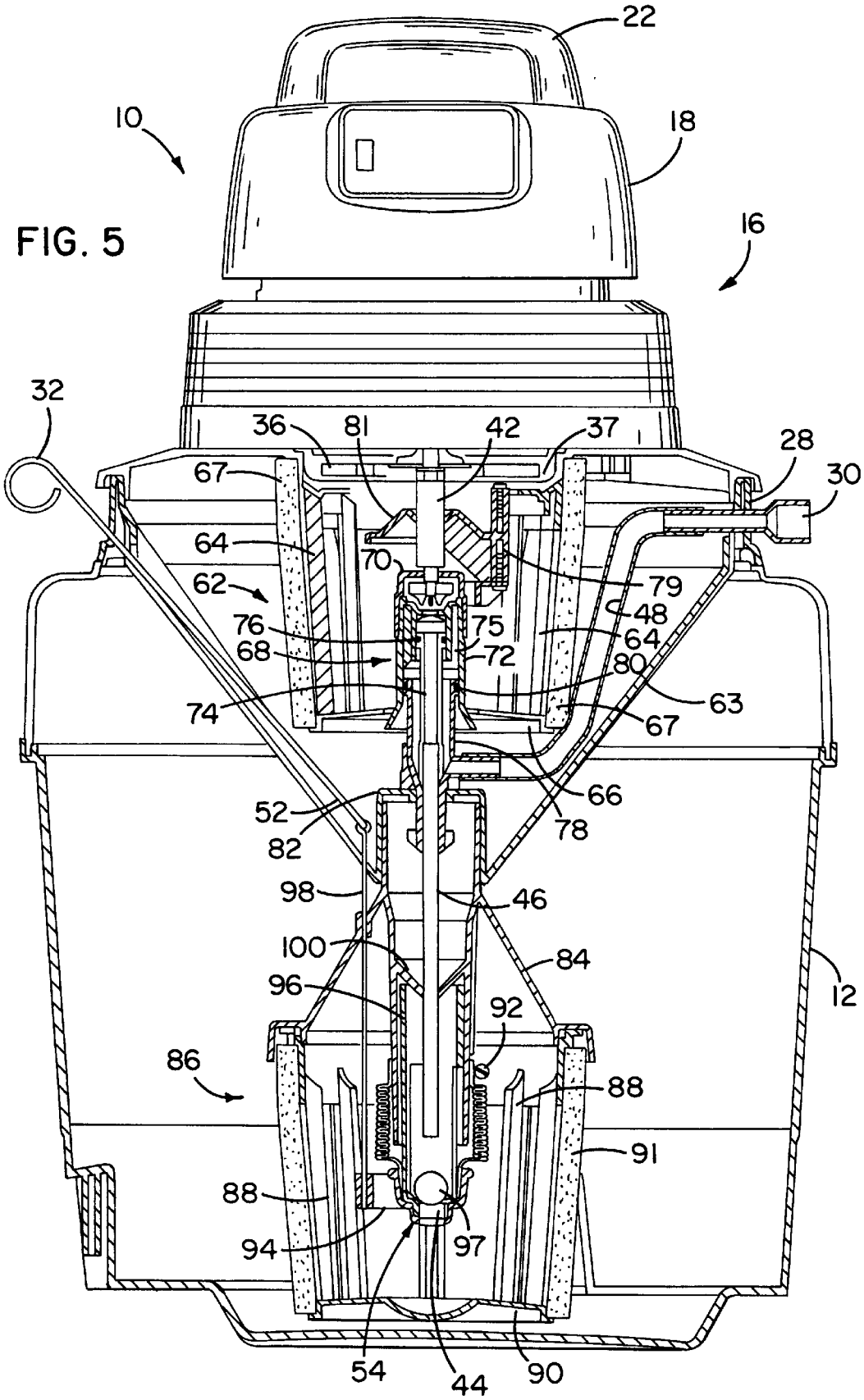
FIG. 5 is a view similar to FIG. 4 showing the pump of the vacuum cleaner being primed.

FIG. 5 depicts the cup 96 in its upper position. The cup 96 is moved upward by a user pulling the priming handle 32, thereby lifting the priming rods 52 and 98 and the bracket 94. In moving from the position of FIG. 4 to the position of FIG. 5, liquid in the cup 96 and the bellows 50 is forced up into inlet tube 46 and eventually to the pump impeller 40. A seal 100 in the intake support 84 prevents liquid and/or air in the support 84 from being pushed farther up into intake support 84 to force liquid in the cup 96 into intake tube 46. The bellows 50 compresses when the cup 96 is in its upper position and also prevents liquid in the cup 96 from leaking back into the tank 12.

Figure 6:
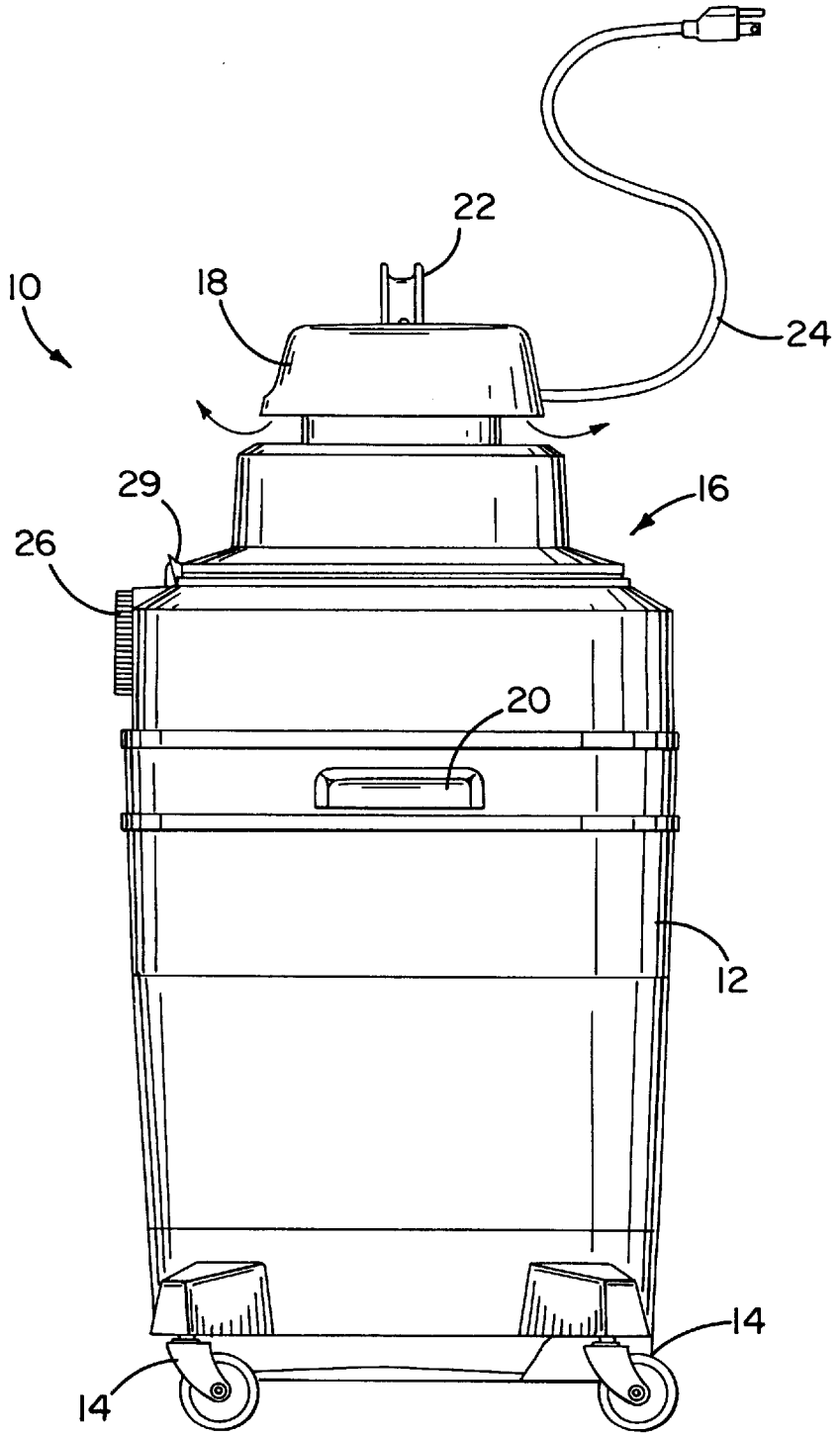
FIG. 6 is a side-elevational view of a vacuum cleaner of the present invention with the lid extension removed.
Figure 7:
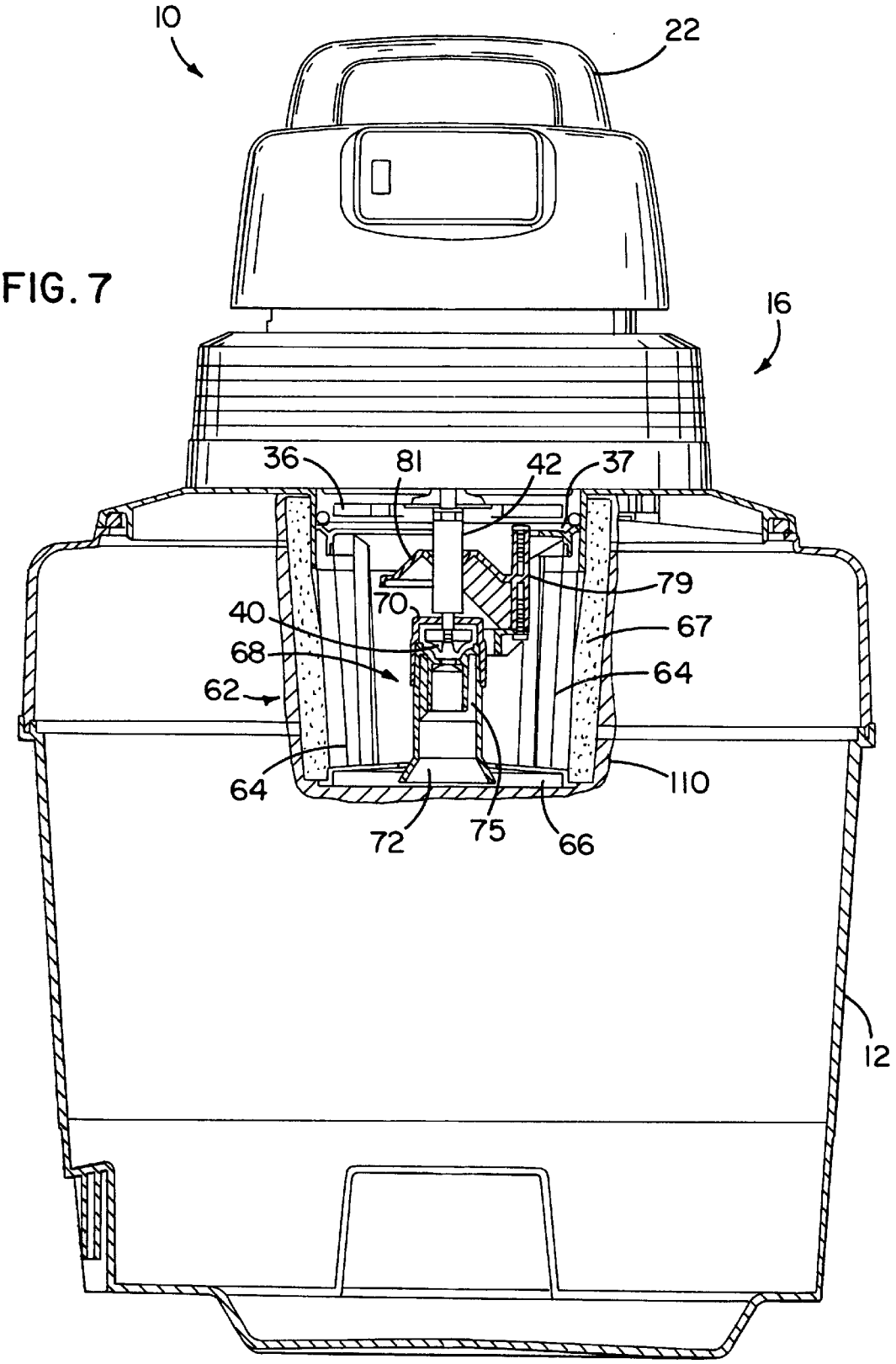
FIG. 7 is a view similar to FIG. 4 of the vacuum cleaner of FIG. 6.

FIGS. 6–7 depict the vacuum cleaner with the lid extension 28 (FIGS. 1 and 5) and its associated components removed from between the tank 12 and the lid 16. By removing the tank extension 28 and the entire inlet assembly for the pump 68, the vacuum cleaner 10 is readily usable for suctioning dry material. With the tank extension 28 and associated components removed, there is additional capacity for vacuuming dry material. Further, the removed pump inlet components will not be clogged with dry material when later used to expel liquid material from the tank 12. In addition, the openings through the tank extension 28 for the priming rod 52 and pump outlet 30, which might otherwise allow air to leak into the tank 12, are not present when the vacuum cleaner 10 is used on dry material. Thus, removability of the tank extension 28 may also increase the suctioning ability of the vacuum cleaner 10 when used on dry material.

The vacuum cleaner 10 can be used to vacuum wet or dry material with the tank extension 28 either in place or removed. With the tank extension in place (FIGS. 1–5), the vacuum cleaner 10 is advantageously configured for suctioning liquid material since that material can be readily removed from the tank 12. Similarly, with the tank extension 28 removed (FIGS. 6 and 7), the vacuum cleaner 10 is advantageously configured for suctioning of dry material.

Referring once again to FIG. 3, the tank extension 28 has a latch or latches, indicated generally at 102, which are each held to the tank extension 28 by a screw 104. The latches 102 each have a locking arm 106 which engages an edge of the tank 12 to hold the tank extension 28 to the tank. A tab 108 on the latch 102 is accessible to a user when the lid 16 has been removed from the tank 12 and tank extension 28 by unlocking the latch 29. Rotation of the tab 108 about the screw 104 releases the tank extension 28 from the tank 12.

As can be seen by comparing FIG. 3 with FIG. 7, removal of the lid 16 from the tank extension 28 divides the pump 68 into an upper pump assembly and a lower pump assembly. The upper pump assembly includes the upper impeller housing 70, the lower impeller housing 72, the pump impeller 40, and their associated components. The lower pump assembly includes the inlet tube 74, pump outlet fitting 78, the inlet tube 46, outlet tube 48, and their associated components. All components of the upper pump assembly are attached to and, during normal operation by a user, remain with the lid 16. All components of the lower pump assembly are attached to and, during normal operation by a user, remain with the tank extension 28. Therefore, when the lid 16 is separated from the tank extension 28, the upper pump assembly separates from the lower pump assembly at the seals 76 and 80. The lower portion of the lower impeller housing 72 is flared to facilitate insertion of the lower pump assembly into the upper pump assembly upon reconfiguration of the vacuum cleaner 10 for removal of liquid material from the tank 12. The flared end of the lower impeller housing 72 aligns the seals 76 and 80 to provide the proper relationship of the components of the pump 68.

As seen in FIG. 7, once the tank extension 28 and its associated lower pump assembly are removed from the lid cage 62, a particulate filter 110 may be placed over the lid cage 62. The particulate filter 110 covers the plate 66 and the opening in the plate 66 through which the lower impeller housing 72 extends.

The vacuum cleaner of the present invention has significant advantages over prior vacuum cleaners. By providing a pump to remove liquid from the tank, liquid can be emptied easily into drains at a variety of heights. Driving the pump impeller off of the same motor which drives the air impeller, significantly reduces the cost of the vacuum cleaner over designs which require a separate motor for the pump. By locating the pump in the tank directly below the air impeller (s), the pump impeller can be simply and efficiently driven off a single axle connected to the air impeller. Removability of portions of the pump, including its intake tube, provides significant efficiency when the vacuum cleaner is used on dry material. Attaching the removable portions of the pump to a tank extension, which is removably mounted to the edge of the vacuum tank, permits easy removal and reinstallation of the pump components from the tank.

The foregoing detailed description has been given for clearness of understanding only, and no unnecessary limitations should be understood therefrom, as modifications would be obvious to those skilled in the art.

We claim:

1. A wet/dry vacuum cleaner comprising:

a tank for receiving vacuumed material;

a tank lid;

a motor and an air impeller carried by the tank lid;

a pump for removing liquid material from the tank; and the pump comprising an upper pump assembly and a lower pump assembly;

wherein the upper pump assembly includes a pump impeller and the upper pump assembly is attached to the lid;

the lower pump assembly includes a pump inlet tube disposed within the tank, wherein the pump inlet tube communicates with a lower portion of the tank; and the lower pump assembly is removably attached to the upper pump assembly.

2. The vacuum cleaner of claim 1 comprising a tank extension, wherein;

the tank extension is supported by the tank between the tank and the tank lid;

the tank extension is removable from the tank and the tank lid; and the tank extension carries the lower pump assembly.

3. The vacuum cleaner of claim 2 comprising an outlet for the pump passing through the tank extension.

4. The vacuum cleaner of claim 2 comprising a priming handle passing through the tank extension.

5. The vacuum cleaner of claim 1 comprising:

a bellows connected to the pump inlet tube wherein the bellows has an opening to permit liquid in the tank to enter the bellows; and means for compressing the bellows to force liquid in the bellows toward to the pump impeller.

6. The vacuum cleaner of claim 5 wherein:

the means for compressing the bellows comprises a handle;

the handle is located outside the tank; and the handle is connected to the bellows.

7. The vacuum cleaner of claim 1 wherein:

the upper pump assembly comprises an impeller housing;

the lower pump assembly comprises a pump outlet fitting and an inlet tube having a seal;

the pump outlet fitting communicates with an outlet to the tank;

the pump outlet fitting has a seal; and the seal on the inlet tube and the seal on the outlet fitting are separable from the impeller housing making the lower pump assembly separable from the upper pump assembly.

8. The vacuum cleaner of claim 1 wherein the lower pump assembly comprises a fluid filter and means for sending a priming fluid toward the pump impeller.

9. A vacuum cleaner comprising:

a tank for collecting vacuumed material, the tank defining an inlet through which the vacuumed material passes;

a source of mechanical force for driving a first and a second shaft, wherein the first shaft is essentially collinear with the second shaft;

an air impeller housing defining an opening in communication with the tank;

an air impeller disposed in the air impeller housing, secured to the first shaft and driven by the source of mechanical force for creating a low pressure area in the tank to draw material into the tank;

a pump located in the tank, the pump having a pump impeller which is secured to the second shaft and driven by the source of mechanical force;

an inlet to the pump disposed within the tank and located near a lower portion of the tank; and an outlet to the pump exterior to the tank;

wherein liquid material in the tank is drawn into the pump inlet by the pump impeller and expelled through the pump outlet.

10. The vacuum cleaner of claim 9 wherein the second shaft connects the air impeller to the pump impeller.

11. The vacuum cleaner of claim 9 comprising:

a bellows connected to the pump inlet wherein the bellows has an opening to permit liquid in the tank to enter the bellows; and means for compressing the bellows to force liquid in the bellows toward to the pump impeller.

12. The vacuum cleaner of claim 11 wherein:

the means for compressing the bellows comprises a handle;

the handle is located outside the tank; and the handle is connected to the bellows.

13. The vacuum cleaner of claim 9 comprising:

a lower pump assembly comprising the pump inlet; and an upper pump assembly including the pump impeller;

wherein the lower pump assembly is removably attached to the upper pump assembly.

14. The vacuum cleaner of claim 13 wherein the lower pump assembly comprises a fluid filter and means for sending a priming fluid toward the pump impeller.

15. The vacuum cleaner of claim 13 comprising a tank lid wherein the tank lid carries the source of mechanical force, the air impeller, and the upper pump assembly.

16. The vacuum cleaner of claim 15 comprising a tank extension wherein:

the tank extension is supported by the tank between the tank and the tank lid;

the tank extension is removable from the tank and the tank lid; and the tank extension carries the lower pump assembly.

* * * * *